US007605759B2

(12) United States Patent
Moon et al.

(10) Patent No.: US 7,605,759 B2
(45) Date of Patent: Oct. 20, 2009

(54) MONOPOLE ANTENNA HAVING MATCHING FUNCTION

(75) Inventors: Young-min Moon, Yongin-si (KR); Se-hyun Park, Yongin-si (KR); Young-eil Kim, Yongin-si (KR); Kyeong-sik Min, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 17 days.

(21) Appl. No.: 11/708,632

(22) Filed: Feb. 21, 2007

(65) Prior Publication Data

US 2008/0042905 A1 Feb. 21, 2008

(30) Foreign Application Priority Data

Aug. 18, 2006 (KR) ..... 10-2006-0078323

(51) Int. Cl.
*H01Q 1/24* (2006.01)

(52) U.S. Cl. ..... 343/700 MS; 343/846

(58) Field of Classification Search ..... 343/700 MS, 343/846, 829
See application file for complete search history.

(56) References Cited

U.S. PATENT DOCUMENTS

| | | | | |
|---|---|---|---|---|
| 7,324,049 | B2 * | 1/2008 | Myoung et al. | 343/700 MS |
| 7,345,637 | B2 * | 3/2008 | Mizoguchi et al. | 343/702 |
| 2003/0210187 | A1 | 11/2003 | Wong et al. | |
| 2004/0017315 | A1 * | 1/2004 | Fang et al. | 343/700 MS |
| 2006/0082506 | A1 | 4/2006 | Fang | |

FOREIGN PATENT DOCUMENTS

| | | | |
|---|---|---|---|
| EP | 1551079 | A1 | 7/2005 |
| JP | 2005-303617 | A | 10/2005 |
| KR | 10-2005-0001488 | A | 1/2005 |

* cited by examiner

*Primary Examiner*—Tho G Phan
(74) *Attorney, Agent, or Firm*—Sughrue Mion, PLLC

(57) ABSTRACT

A monopole antenna having a matching function includes a ground; and a radiator having a first radiation part which is connected to a first side of the ground in a strip shape perpendicularly to the ground, and at least one second radiation part which is bent from a first end of the first radiation part at least once.

9 Claims, 5 Drawing Sheets

MONOPOLE ANTENNA HAVING MATCHING FUNCTION

CROSS-REFERENCE TO RELATED APPLICATIONS

This application claims priority from Korean Patent Application No. 2006-78323, filed on Aug. 18, 2006, in the Korean Intellectual Property Office, the entire contents of which is incorporated herein by reference.

BACKGROUND OF THE INVENTION

1. Field of the Invention

Apparatuses and methods consistent with the exemplary embodiments of the present invention relate to a monopole antenna having a matching function. More particularly, the exemplary embodiment of the present invention relates to a monopole antenna having a matching function, which facilitates impedance matching and reduces the antenna size.

2. Description of the Related Art

A general monopole antenna is fabricated with a length of $$\frac{\lambda}{4},$$

which is half the length of a dipole antenna, by an imaging effect using a ground. Thus, the monopole antenna is frequently used in small devices such as mobile communication terminals. Yet, in accordance with the miniaturization of small devices, there is a demand for further miniaturization of the monopole antenna.

To this end, the monopole antenna is formed like a patch antenna and the antenna is miniaturized by changing its shape. However, when the antenna is miniaturized, disadvantageously, the gain of the antenna is lowered and the bandwidth of the operating frequency shrinks. Also, it is difficult to match the impedance of the antenna to 50Ω.

To address these shortcomings, a matching circuit is separately provided to the small antennas for impedance matching. Although it is preferable to place the matching circuit adjacently to the antenna at most, the matching circuit may be positioned adjacently to the antenna or away from the antenna according to its design. When the matching circuit lies away from the antenna, a separate wire is required to interconnect the antenna with the matching circuit. The wire may cause reactance through the operation with the circuit board. The resulting reactance affects the matching circuit and thus changes the impedance of 50Ω which has been matched by the matching circuit.

Without the wire, after the matching circuit is mounted to the device, mismatching may occur because of the operation with another circuit element. When the mismatching occurs, the design of the matching circuit needs to be modified. Such a design change is cumbersome, and it is not easy to change the design of the matching circuit. In addition, a space for the separate matching circuit is required.

Therefore, a solution is needed to reduce a size of a device having a monopole antenna and to facilitate the design of the matching circuit by minimizing the space occupied by the matching circuit in the design phase of the monopole antenna.

SUMMARY OF THE INVENTION

An aspect of the present invention is directed to a monopole antenna having a matching function, which can facilitate impedance matching and miniaturization of the device and the monopole antenna.

According to an aspect of the present invention, a monopole antenna having a matching function includes a ground; and a radiator having a first radiation part which is connected to a side of the ground in a strip shape perpendicularly to the ground, and at least one second radiation part which is bent from a first end of the first radiation part at least once.

The first radiation part may be a first radiation line connected to the ground and a pair of second radiation lines which are arranged at a first side and a second side of the first radiation line at an interval and are spaced apart from the ground.

The first radiation line and the second radiation lines may be linked to each other at a first end of the radiator opposite to the ground.

The first radiation parts may be capacitive.

A pair of the second radiation parts may extend from a first end of the second radiation lines and are bent at least once.

The second radiation part may be formed at the first end of the second radiation line in a '⊏'shape which is open to the outside of the second radiation line.

The second radiation parts may be strip lines formed in a first side and a second side of the second radiation line in a 'U' shape.

The second radiation parts may be a pair of strip lines formed in a first side and a second side of the second radiation line in a reverse 'U' shape.

The second radiation part may be inductive.

BRIEF DESCRIPTION OF THE DRAWING

The above and other aspects of the present invention will become more apparent by describing in detail exemplary embodiments thereof with reference to the attached drawing figures, wherein.

DETAILED DESCRIPTION OF EXEMPLARY EMBODIMENTS OF THE PRESENT INVENTION

Figure 1:
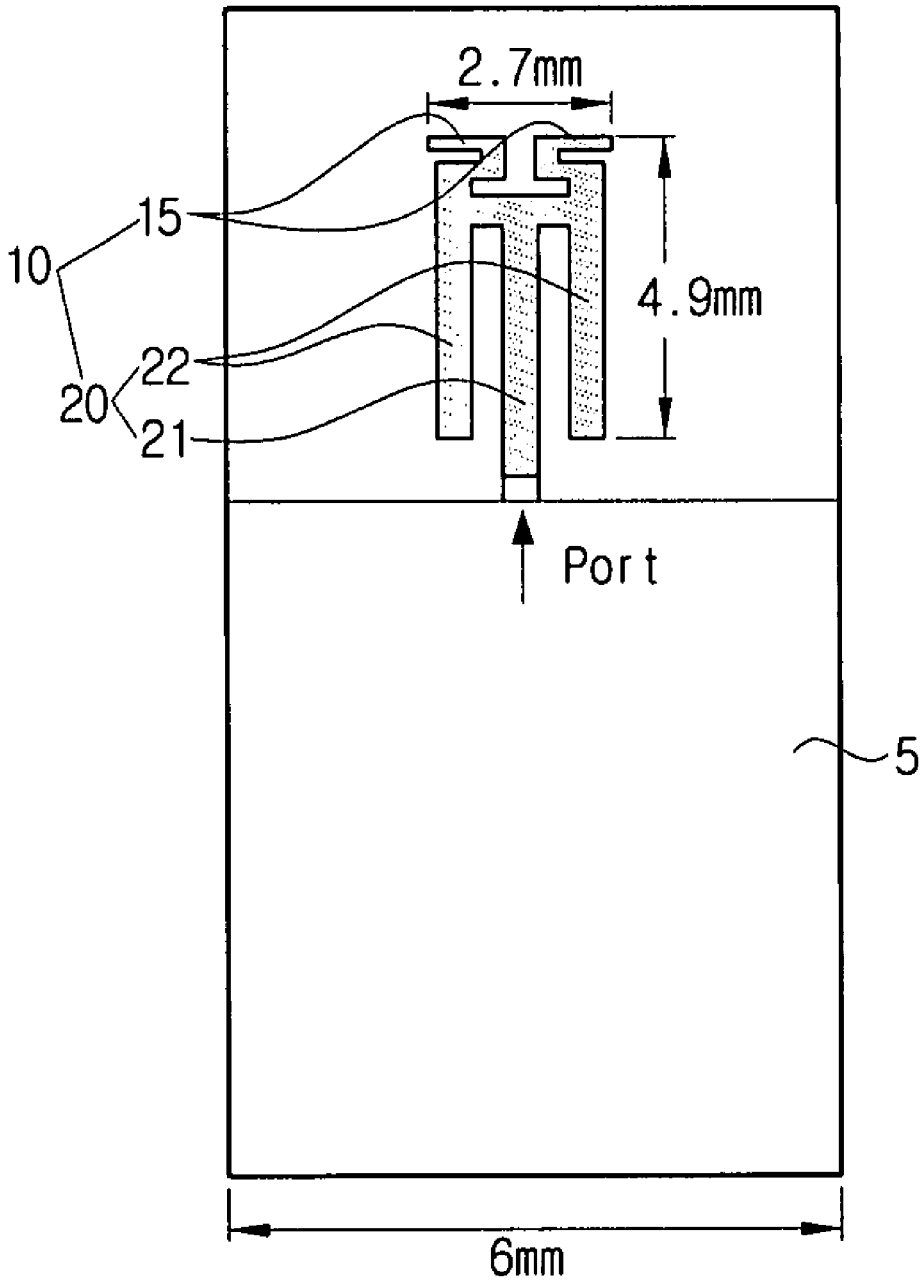
FIG. 1 is a plan view of a monopole antenna according to one exemplary embodiment of the present invention.

Hereinafter, exemplary embodiments of the present invention will be described in detail with reference to the accompanying drawings.

In the following description, same drawing reference numerals are used for the same elements even in different drawings. The matters defined in the description such as a detailed construction and elements are nothing but the ones provided to assist in a comprehensive understanding of the invention. Thus, it is apparent that the exemplary embodiments of the present invention can be carried out without those defined matters. Also, well-known functions or constructions are not described in detail since they would obscure the invention in unnecessary detail.

FIG. 1 is a plan view of a monopole antenna according to one exemplary embodiment of the present invention.

The monopole antenna includes a ground 5 and a radiator 10 of a patch antenna type. The radiator 10 includes a first radiation part 20 including capacitive parts and a second radiation part 15 including inductive parts. The ground 5 is formed on one side of the circuit board in a plate shape.

The first radiation part 20 of the radiator 10 is formed in a strip shape in a perpendicular relation with respect to the ground 5. That is, the first radiation part 20 includes a plurality of radiation lines 21, 22 of an elongated shape. The first radiation line 21 is formed in the middle of the second radiation lines 22, and is connected to a side of the ground 5. Alongside the first radiation line 22, there is a pair of second radiation lines 22 arranged at an interval from the first radiation line 21. The second radiation lines 22 are spaced apart from the ground 5. Ends of the first radiation line 21 and the second radiation lines 22, opposite to the ground 5, are linked to each other.

As the first radiation line 21 and the second radiation lines 22 of the first radiation part 20 are placed in parallel, the first radiation part 20 has the capacitive characteristic.

The second radiation part 15 includes a pair of bent strips connected with an end of the first radiation part 20. The bent strips may be bent one or more times. The pair of bent strips of the second radiation part 15 is connected to the second radiation lines 22 of the first radiation part 20, respectively. The bent strips of the second radiation part 15 are extended vertically from the end of the second radiation line 22, bent and extended toward the first radiation line 21 which is the center of the first radiation part 20, bent and extended vertically again, and then bent and extended toward the second radiation lines 22. That is, the second radiation part 15 is formed in a '⊏'shape. The opening of the second radiation part 15 faces towards the outside of the radiator 10. The bent strips of the second radiation part 15 are formed symmetrically.

The pair of bent strips of the second radiation part 15 has the inductive characteristic.

Figure 2:
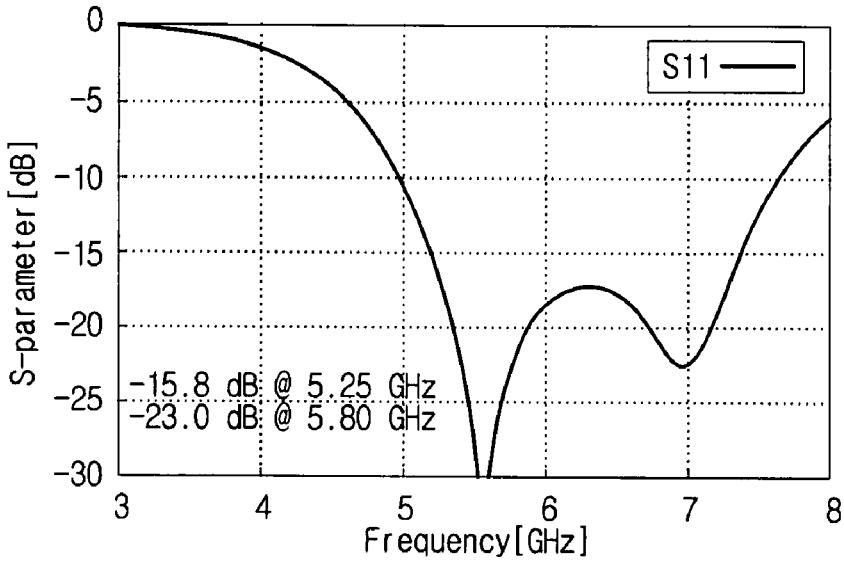
FIG. 2 is a graph showing S11 characteristics of the monopole antenna of FIG. 1.

FIG. 2 is a graph showing S11 characteristics of the monopole antenna of FIG. 1.

The S11 characteristics of the monopole antenna changes according to the lengths of the ground 5, the first radiation part 20, and the second radiation part 15. As shown in FIG. 1, the width of the ground 5 is set to 6 mm, the width of the radiator 10 is set to 2.7 mm, and the length of the radiator 10 is set to 4.9 mm. Under this condition, the S11 characteristics graph of FIG. 2 is exhibited. In FIG. 2, the operating frequency of the monopole antenna at −10 dB ranges 5~7.6 GHz of the wideband frequency bandwidth. The frequency band of 5~7.6 GHz covers the Bluetooth frequency band.

Meanwhile, the matching circuit typically consists of a capacitor or an inductor, or solely an inductor. According one exemplary embodiment of the present invention, since the first radiation part 20 of the radiator 10 is capacitive and the second radiation part 15 is inductive, the monopole antenna carries out the impedance matching, similar to the matching circuit.

Figure 3:
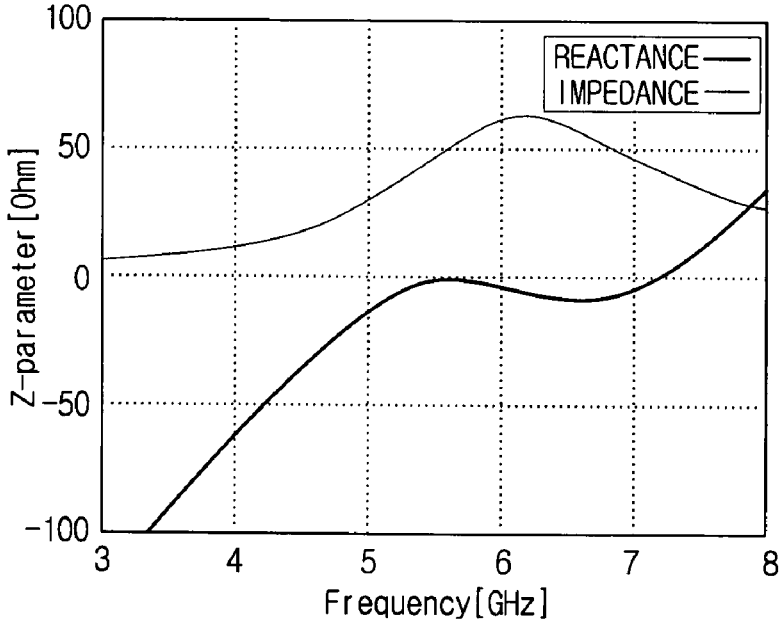
FIG. 3 is a graph showing an impedance and a reactance of the monopole antenna of FIG. 1.

FIG. 3 is a graph showing an impedance and a reactance of the monopole antenna of FIG. 1.

Although the monopole antenna does not have a separate matching circuit, its impedance reaches to 50Ω at about 5.7 GHz and 7.2 GHz and its reactance is close to zero as shown in FIG. 3. Therefore, the monopole antenna does not need a separate matching circuit.

Figure 4:
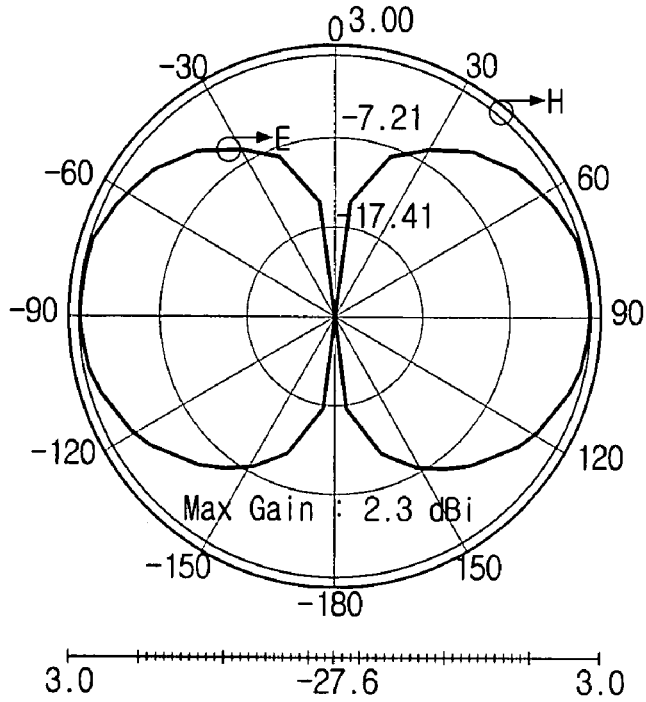
FIG. 4 is a graph showing a radiation pattern of the monopole antenna of FIG. 1.

FIG. 4 is a graph showing a radiation pattern of the monopole antenna of FIG. 1.

As shown in FIG. 4, the monopole antenna has the omnidirectional radiation pattern and the gain of 2.3 dBi. In other words, the monopole antenna not only exhibits the omnidirectionality suitable for mobile communication terminals but also has good gain.

As such, the size of the monopole antenna can be miniaturized by bending the strip several times and a matching circuit is not required. Also, the performance of the antenna can be enhanced because the bandwidth of the operating frequency is extended.

Figure 5:
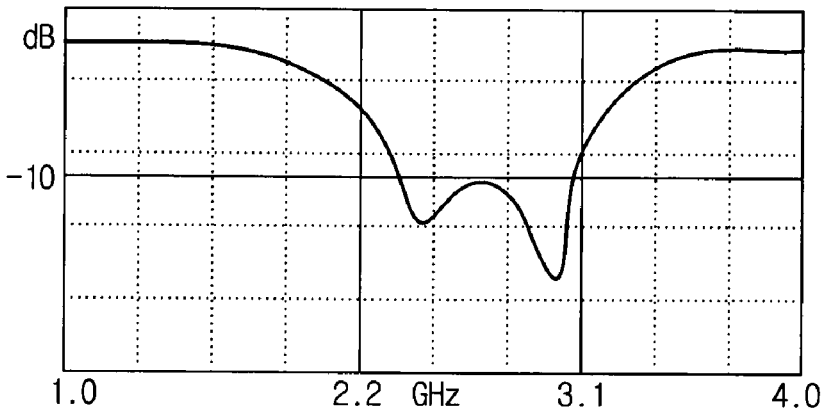
FIG. 5 is a graph showing an operating frequency measured by adjusting a size of the monopole antenna of FIG. 1.

FIG. 5 is a graph showing an operating frequency measured by adjusting a size of the monopole antenna of FIG. 1.

In FIG. 5, the operating frequency is measured when the width of the radiator 10 is set to approximately 6.5 mm and the length is set to approximately 17 mm. The monopole antenna operates in the frequency band of 2.2~3.1 GHz at −10 dB. The center frequency of the monopole antenna is 2.35 GHz. The monopole antenna can operate in the WiBro frequency band and can thus be used as a WiBro antenna. It should be appreciated that the operating frequency band of the monopole antenna can be changed by adjusting the sizes of the radiator 10 and the ground 5.

Figure 6:
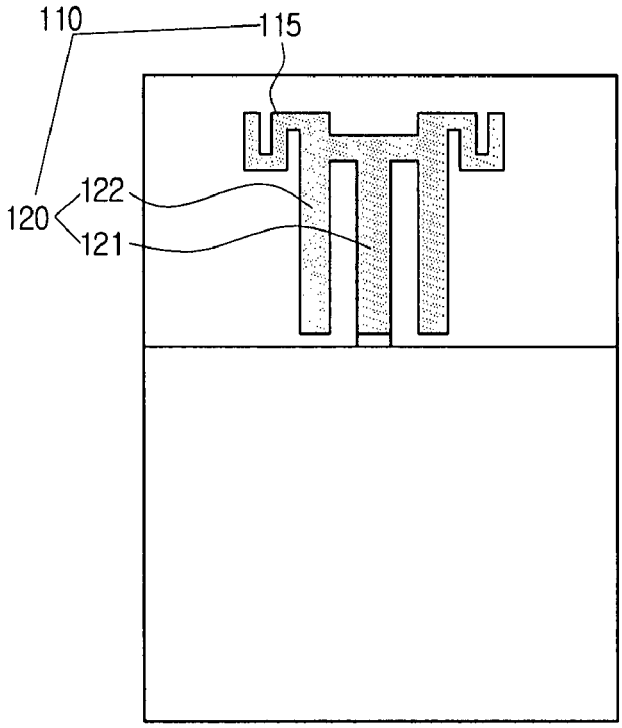
FIG. 6 is a plan view of a monopole antenna according to another exemplary embodiment of the present invention.

FIG. 6 is a plan view of a monopole antenna according to another exemplary embodiment of the present invention.

In the monopole antenna, a first radiation part 120 of a radiator 110 has the same shape as in one exemplary embodiment of the present invention, but a second radiation part 115 is formed in a different shape.

In another exemplary embodiment of the present invention, a pair of strips of the second radiation part 115 of the monopole antenna may be extended from the second radiation lines 122, bent and extended in the opposite direction to the first radiation line 121, bent and extended downward in parallel with the second radiation line 122, bent and extended outward, and then bent and extended upward in parallel with the second radiation lines 122. That is, the second radiation part 115 is formed in a 'U' shape at both sides of the first radiation part 120.

Figure 7:
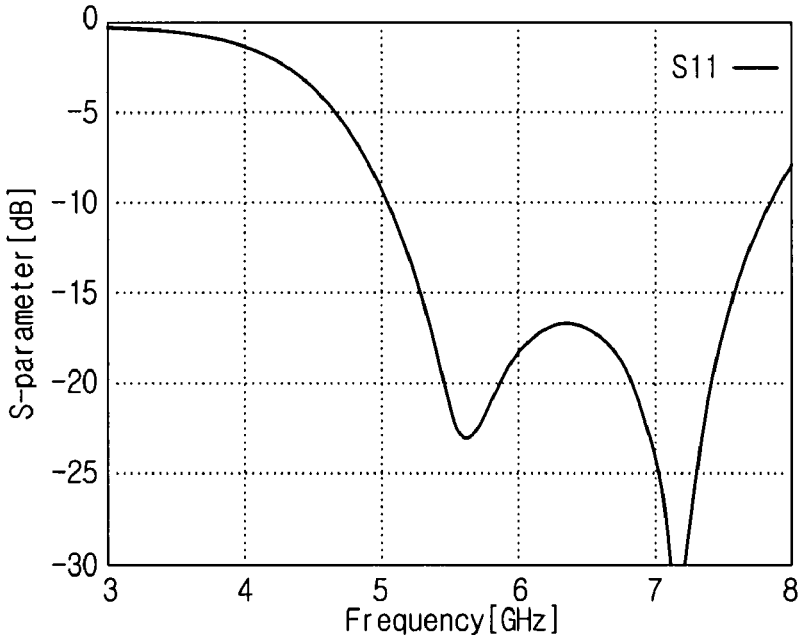
FIG. 7 is a graph showing S11 characteristics of the monopole antenna of FIG. 6.

FIG. 7 is a graph showing S11 characteristics of the monopole antenna of FIG. 6.

The monopole antenna has the operating frequency of about 5.1~7.8 GHz at −10 dB which is substantially the same operating frequency as the monopole antenna of FIG. 1.

Figure 8:
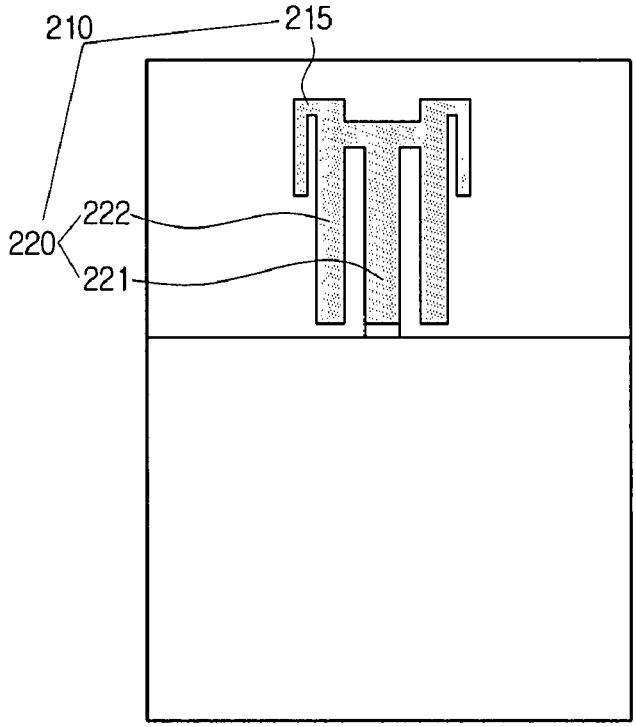
FIG. 8 is a plan view of a monopole antenna according to still another exemplary embodiment of the present invention.

FIG. 8 is a plan view of a monopole antenna according to still another exemplary embodiment of the present invention.

In the monopole antenna, the shape of a first radiation part 220 of radiator 210 is the same as in the above exemplary embodiments of the present invention, but merely the shape of a second radiation part 215 is different.

The second radiation part 215 is extended upward from the second radiation lines 222, bent and extended in the opposite direction of the first radiation line 221, and then bent and extended downward in parallel with the second radiation lines 222. Accordingly, the strips of the second radiation part 215 are formed in a reverse 'U' shape at both ends of the first radiation part 220.

Figure 9:
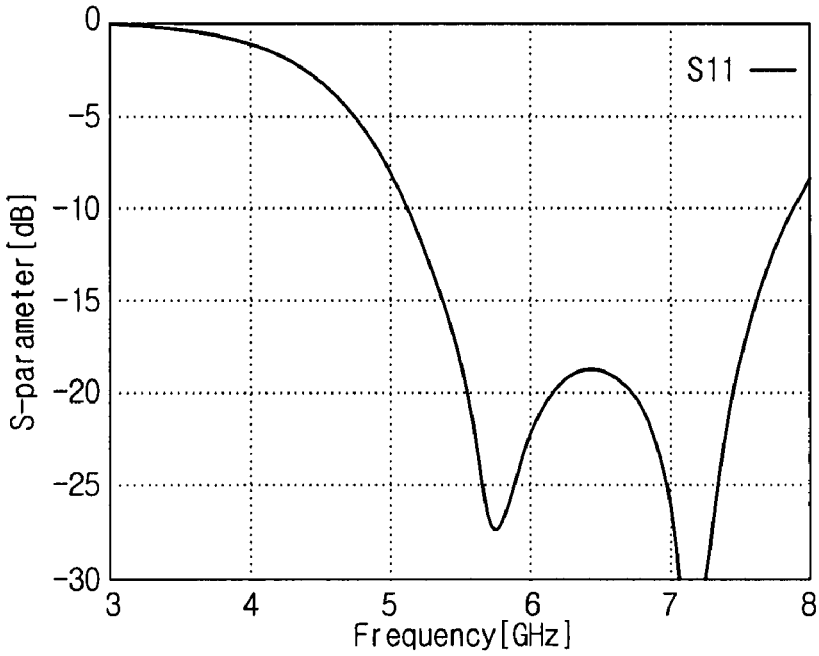
FIG. 9 is a graph showing S11 characteristics of the monopole antenna of FIG. 8.

FIG. 9 is a graph showing S11 characteristics of the monopole antenna of FIG. 8.

The monopole antenna has the operating frequency of about 5.2~7.8 GHz at −10 dB. That is, the monopole antenna runs substantially in the same operation frequency as the monopole antennas of FIGS. 1 and 6.

Accordingly, the monopole antennas of FIGS. 6 and 8 can be employed in small devices and used for Bluetooth or WiBro as well as the monopole antenna of FIG. 1.

In light of the foregoing, the size of the antenna can be miniaturized by bending the antenna several times and a matching circuit is not required. Additionally, the performance of the antenna can be enhanced by expanding the bandwidth of the operating frequency.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A monopole antenna having an impedance matching function comprising:

a ground; and a radiator comprising a first radiation part which is connected to a first side of the ground in a strip shape perpendicular to the ground, and at least one second radiation part which is bent from a first end of the first radiation part at least once, wherein the first radiation part is capacitive.

2. The monopole antenna claimed as in claim 1, wherein the first radiation part comprises a first radiation line connected to the ground, and a pair of second radiation lines arranged at a first side and a second side of the first radiation line at an interval and spaced apart from the ground.

3. The monopole antenna claimed as in claim 2, wherein a pair of second radiation parts extend from a first end of the second radiation lines and are bent at least once.

4. The monopole antenna claimed as in claim 3, wherein the second radiation parts comprise a pair of strip lines formed in a first side and a second side of the second radiation line in a 'U' shape.

5. The monopole antenna claimed as in claim 1, wherein the second radiation part is inductive.

6. A monopole antenna having an impedance matching function comprising:

a ground; and a radiator comprising a first radiation part which is connected to a first side of the ground in a strip shape perpendicular to the ground, and at least one second radiation part which is bent from a first end of the first radiation part at least once, wherein the first radiation part comprises a first radiation line connected to the ground, and a pair of second radiation lines arranged at a first side and a second side of the first radiation line at an interval and spaced apart from the ground, and wherein the first radiation line and the second radiation lines are connected with each other at said first end opposite to the ground.

7. A monopole antenna having an impedance matching function comprising:

a ground; and a radiator comprising a first radiation part which is connected to a first side of the ground in a strip shape perpendicular to the ground, and at least one second radiation part which is bent from a first end of the first radiation part at least once, wherein the first radiation part comprises a first radiation line connected to the ground, and a pair of second radiation lines arranged at a first side and a second side of the first radiation line at an interval and spaced apart from the ground, and wherein the second radiation part is formed at the first end of the second radiation line in a shape which opens to an outside of the second radiation line.

8. The monopole antenna claimed as in claim 7, wherein the second radiation part is formed at the first end of the second radiation line in a "⊏" shape which is open to outside of the second radiation line.

9. A monopole antenna having an impedance matching function comprising:

a ground; and a radiator comprising a first radiation part which is connected to a first side of the ground in a strip shape perpendicular to the ground, and at least one second radiation part which is bent from a first end of the first radiation part at least once, wherein the first radiation part comprises a first radiation line connected to the ground, and a pair of second radiation lines arranged at a first side and a second side of the first radiation line at an interval and spaced apart from the ground, wherein a pair of second radiation parts extend from a first end of the second radiation lines and are bent at least once, and wherein the second radiation parts comprise a pair of strip lines formed in a first side and a second side of the second radiation line in a reverse 'U' shape.

* * * * *